United States Patent [19]

Lassy et al.

[11] 4,320,740

[45] Mar. 23, 1982

[54] FIREPLACE HEATER WITH REFLECTOR, HEAT RETAINER, FORCED DRAFT AND GRATE

[76] Inventors: Carl O. Lassy, 376 South St.; William A. Lassy, 73 Grove Ave., Forestville Station, both of Bristol, Conn. 06010

[21] Appl. No.: 972,474

[22] Filed: Dec. 22, 1978

[51] Int. Cl.[3] ..... F24B 7/00

[52] U.S. Cl. ..... 126/121; 126/135; 126/142

[58] Field of Search ..... 126/121, 141, 142, 131, 126/135, 123; 237/51; D23/94–97

[56] References Cited

U.S. PATENT DOCUMENTS

| | | | |
|---|---|---|---|
| D. 248,565 | 7/1978 | Watson | D23/94 |
| 374,334 | 12/1887 | Backus | 126/135 X |
| 1,142,960 | 6/1915 | Hitt | 126/135 |
| 2,143,772 | 1/1939 | Hannula | 126/121 |
| 2,161,723 | 6/1939 | Rutland | 126/121 |
| 2,671,440 | 3/1954 | Dupler | 126/121 |
| 3,901,212 | 8/1975 | Stites | 126/121 |
| 3,905,351 | 9/1975 | Hatfield et al. | 126/121 |
| 3,930,490 | 1/1976 | Lassy et al. | 126/121 |
| 3,942,509 | 3/1976 | Sasser | 126/121 |
| 4,026,263 | 5/1977 | Boyd | 126/135 X |
| 4,088,114 | 5/1978 | Johnson | 126/121 X |
| 4,114,590 | 9/1978 | Frahm | 126/121 |
| 4,122,825 | 10/1978 | Slate | 126/121 |
| 4,185,611 | 1/1980 | Johnson | 126/121 |

FOREIGN PATENT DOCUMENTS

| | | | |
|---|---|---|---|
| 978392 | 12/1964 | United Kingdom | 126/121 |

*Primary Examiner*—Stephen P. Garbe
*Attorney, Agent, or Firm*—Harvey B. Jacobson

[57] ABSTRACT

A fireplace heater includes heat exchange tubes or pipes installed in a fireplace with the lower ends of certain tubes being interconnected by a manifold and the upper ends of the tubes being in communication with a heating chamber in a manner such that cold air from floor level will pass inwardly and upwardly through certain of the tubes and downwardly and outwardly of the manifold from certain of the other tubes for discharge of heated air at or adjacent floor level. The heat exchange pipes or tubes are provided with a grate supporting the logs, a reflector plate extends between the grate and the heating chamber at the upper ends of the tubes and a log retaining plate at the forward edge of the grate. In addition, a heat retaining plate is pivotally attached to the upper heating chamber in a manner to provide a space therebetween so that the heat retaining plate which projects forwardly from the top heating chamber will retain the products of combustion and cause them to pass in more intimate heat exchange relationship to the top heating chamber and around the heating. Additionally, a cover plate rests on top of the front log retaining plate and engages the front edge of the heat retaining plate and a side plate or plates is provided to further enclose the logs or other fuel with a forced draft arrangement facilitating combustion of logs or the like and the device may be used with a panel including a closure door for the fireplace opening, thereby rendering the device substantially universal in installation.

10 Claims, 6 Drawing Figures

FIG. 2
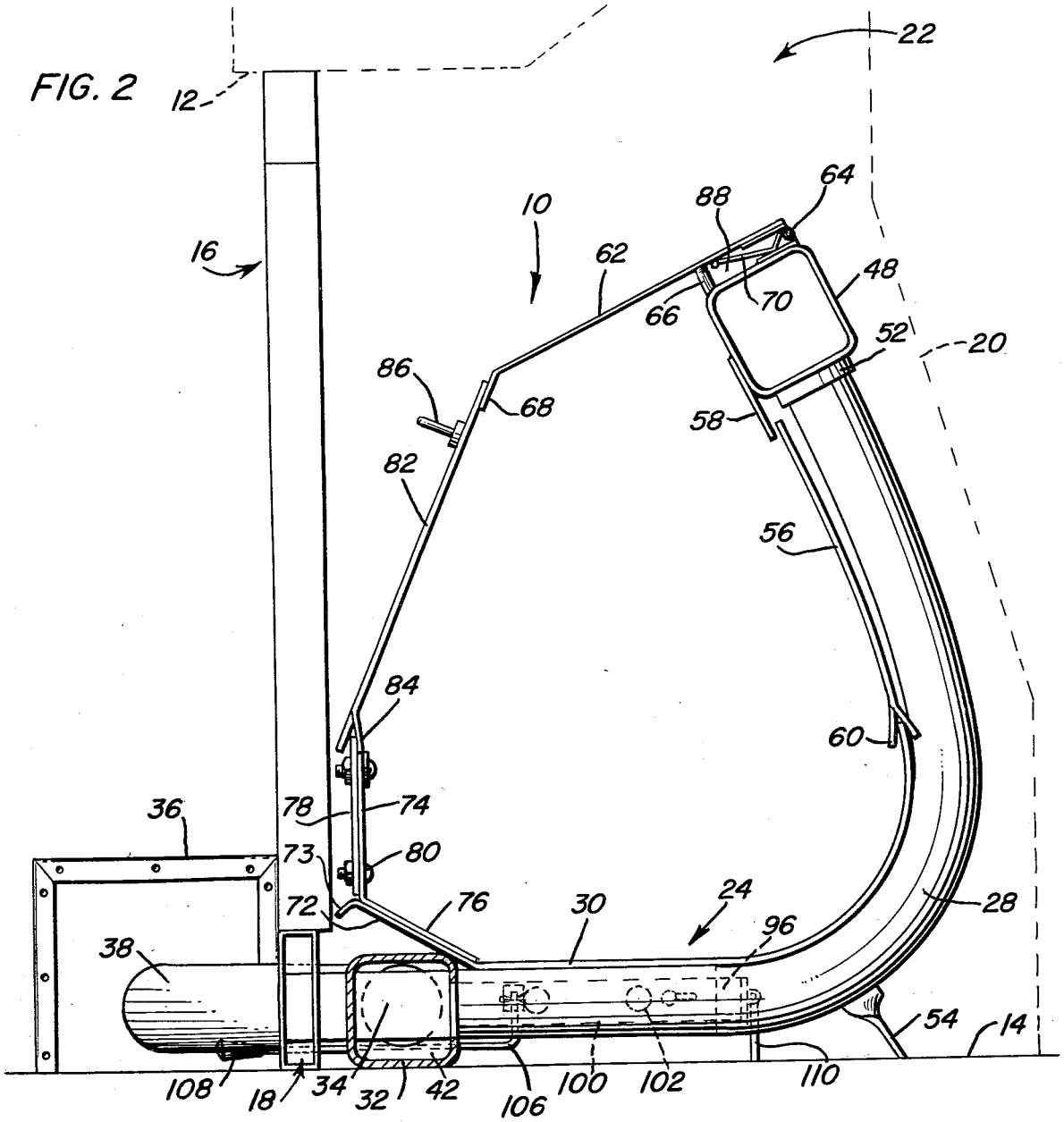
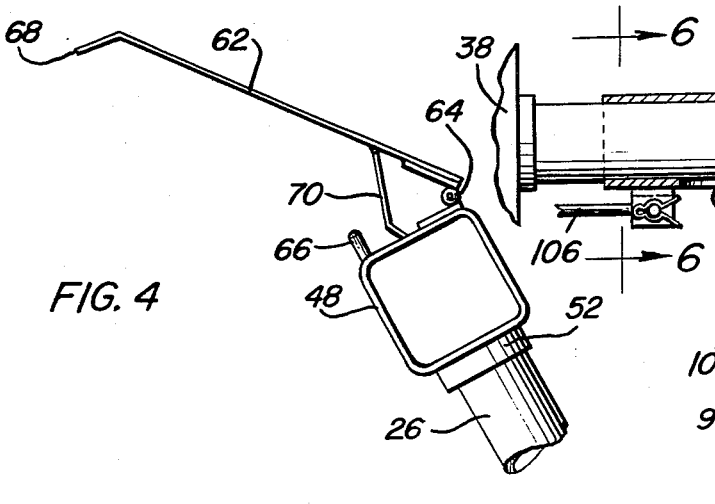
FIG. 4
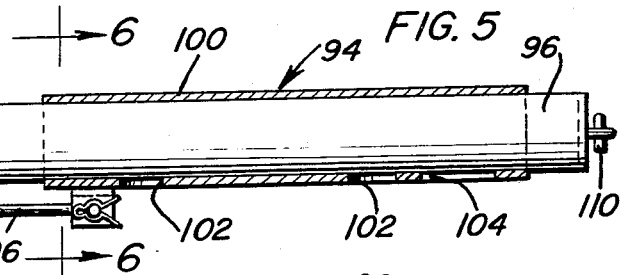
FIG. 5
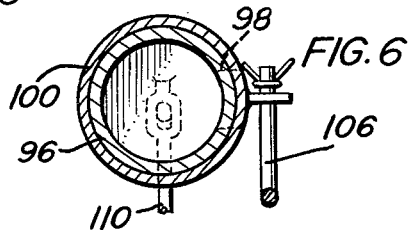
FIG. 6

FIREPLACE HEATER WITH REFLECTOR, HEAT RETAINER, FORCED DRAFT AND GRATE

BACKGROUND OF THE INVENTION

1. Field of the Invention

The present invention generally relates to a fireplace heater which includes a forced air circulating structure in the form of tubular heater members associated with manifolds, a grate, a reflector plate, a front log retaining plate, a top heat retaining plate, a cover forming a closure between the log retaining plate and the top heat retaining plate, a forced air draft arrangement and optional side or end plates with all of the structure being arranged for easy assembly and disassembly for storage and shipment in a compact condition and including interchangeable components to enable installation in various types of fireplaces.

2. Description of the Prior Art

Many efforts have been made to more efficiently utilize the heat produced by burning logs or other fuel in a fireplace. The simpliest type of device is the provision of generally U-shaped tubes interconnected to form a grate for the combustible logs with the lower ends of the tubes providing cold air inlet and the upper ends of the tubes providing hot air outlets with both the upper and lower ends of the tubes extending toward the front of the fireplace in order to discharge hot air into the space immediately outwardly of the fireplace. Due to the limitations of air circulation in such devices, a lower manifold was connected with the lower ends of the tubes and a circulating fan communicated therewith to provide forced air circulation from floor level up through the tubes and out of the front ends of the tubes which provide further distribution of hot air outwardly of the fireplace, but such air was discharged at the upper portion of the fireplace, thus leaving the space adjacent floor level of a room or the like relatively cold. In our prior U.S. Pat. No. 3,930,490, issued Jan. 6, 1976, for Fireplace Heater there is disclosed a structure for more effective heat exchange with the combustion products formed by the combustion of logs or other fuel in the fireplace and a structure for taking in cold air at floor level, forcing it through heat exchange tubes and then discharging it outwardly of the fireplace adjacent floor level for less air temperature stratification in the room in which the fireplace is located. In addition, the following patents disclose heaters associated with fireplaces for either forced or gravitational air circulation:

| | |
|---|---|
| U.S. Pat. Nos: | 737,381 - Aug. 25, 1903 |
| | 1,313,085 - Aug. 12, 1919 |
| | 1,608,745 - Nov. 30, 1926 |
| | 1,640,771 - Aug. 30, 1927 |
| | 1,783,140 - Nov. 25, 1930 |
| | 2,052,643 - Sep. 1, 1936 |
| | 2,131,763 - Oct. 4, 1938 |
| | 2,702,030 - Feb. 15,1955 |
| | 2,828,078 - Mar. 25, 1958 |
| | 3,001,521 - Sep. 26, 1961 |
| | 3,240,206 - Mar. 15, 1966 |
| | 3,269,383 - Aug. 30, 1966 |
| | 3,452,737 - July 1, 1969 |
| | 3,635,211 - Jan. 18, 1972 |
| | 3,945,369 - Mar. 23, 1976 |
| | 4,018,209 - Apr. 19, 1977 |
| British Pat. No. | 900,622 - July 11, 1962. |

While all of the prior devices operate for the purposes intended, more efficient heat transfer at less cost is desirable.

SUMMARY OF THE INVENTION

An object of the present invention is to provide a fireplace heater utilizing tubes or pipes interconnected to provide a fireplace heater with a grate mounted thereon for supporting logs or other combustible material with the lower ends of the pipes being interconnected by a manifold having an air circulating fan communicating therewith and certain of the pipes communicated therewith, together with an upper heating chamber connecting and communicating with all of the pipes so that cold air from the floor will be discharged from the fan into the manifold upwardly through certain of the pipes and into the upper heating chamber and then downwardly through the remainder of the pipes which project forwardly through the manifold for discharge of hot air adjacent floor level.

Another object of the invention is to provide a fireplace heater in accordance with the preceding object, together with a heat reflector plate positioned on top of the rear edge of the grate and engaged with the heat chamber to form a closure for the rear of the fireplace heater and reflecting heat forwardly from the fireplace.

A further object of the invention is to provide a fireplace heater in accordance with the preceding objects, together with a heat retaining plate hingedly connected to the heat chamber but in vertically spaced overlying relation thereto to guide combustion products into more intimate and more efficient heat exchange relationship to the heating chamber and other components of the fireplace heater.

Still another object of the invention is to provide a fireplace heater in accordance with the preceding objects, together with a front log retaining plate and a cover plate extending between the front log retaining plate and the forward edge of the heat retaining plate to form a front closure for the fireplace heater which can be easily removed to enable insertion of logs or other combustible material into the fireplace heater.

A still further object of the invention is to provide a fireplace heater in accordance with the preceding objects, together with removable side or end plates which can be optionally used and which form a closure for a portion of the vertical height of either or both ends of the fireplace heater.

Yet another object of the invention is to provide a fireplace heater in accordance with the preceding objects, in which the air circulating fan is provided with a forced draft arrangement for supplying combustion supporting air to the fireplace heater.

Yet further objects of the invention reside in the construction of the fireplace heater with components which are easily assembled at the side of installation, thereby enabling the device to be stored and shipped in a compact condition and with the components being interchangeable in such a manner to enable various installational requirements to be effectively satisfied with the fireplace heater efficiently utilizing the heat produced by the combustible logs and effectively discharging the heated air into a room, air circulating ducts, or to any other desired location.

In this invention, the fireplace grate becomes a high temperature firebox, burns the gases low inside the grate, similar to a coal fire, turning the wood into hot, long burning coals with temperatures to 1400° F. plus.

The grate has a long life far exceeding the well-known cast iron grate that feeds oxygen up from the bottom and through the fire. With our grate, the oxygen feeds up from the bottom traveling along the outside of the front portion of grate then over the top of the fire and to the back of the fireplace then traveling upward and out. Wood is completely consumed to a white powdery ash, with a very small ash build up requiring very infrequent clean out even when the fireplace is burned continuously The heat retaining plate placed on an angle, guides the combustive gases upwardly to the back of the fireplace, into the fireplace throat, thereby assuring that no gases spill outwardly into the room.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a vertical sectional view taken substantially upon a plane passing along section line 2—2 of FIG. 1 illustrating the specific structural details of the fireplace heater.

FIG. 4 is a detailed sectional view of the heat chamber illustrating the heat retaining plate in elevated position with a pivotal prop securing the plate in this position to enable large logs to be placed into the fireplace heater.

FIG. 5 is a fragmental plan view of the forced draft device disposed along one side of the fireplace heater.

FIG. 6 is a sectional view of the forced air draft device illustrating further structural details thereof.

DESCRIPTION OF THE PREFERRED EMBODIMENT

Figure 1:
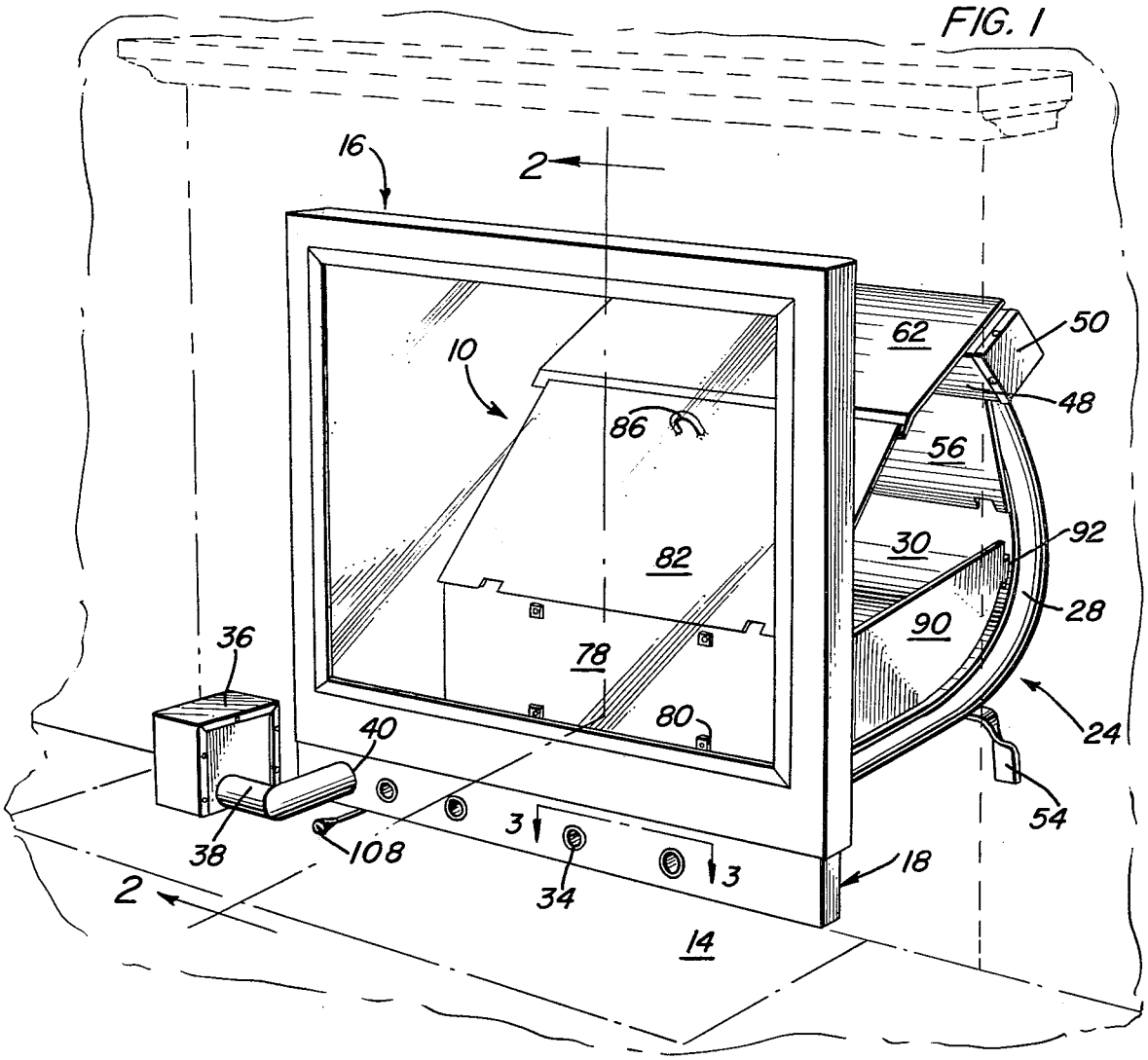
FIG. 1 is a perspective view of the fireplace heater of the present invention with the fireplace being diagrammatically illustrated to show the relationship of the present invention to an existing fireplace.
Figure 3:
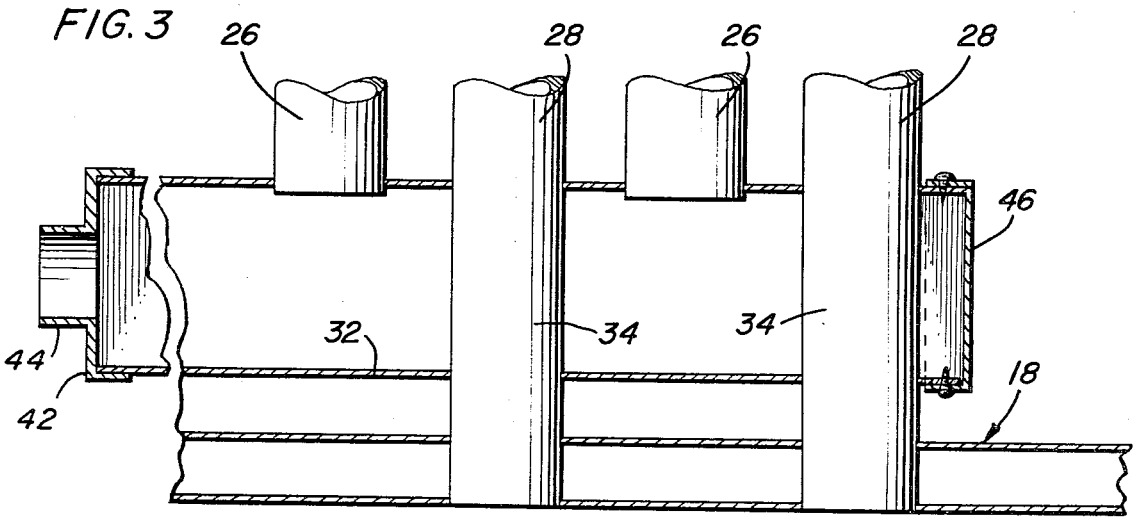
FIG. 3 is a sectional view, on an enlarged scale, illustrating the manifold structure and the relationship of the air inlet and air exhaust pipes.

Referring now specifically to the drawings, the fireplace heater of the present invention is generally designated by reference numeral 10 and is installed in a conventional fireplace opening 12 having the usual damper arm (not shown) and rests on the hearth 14 inwardly of a closure device 16 for the fireplace opening 12 which may be in the form of folding or sliding transparent glass doors or the like, the details of which are not shown, with the lower end of the closure member 16 including an air panel 18 to be described in detail hereinafter. The fireplace heater 10 is disposed with the rear portion thereof to the rear wall 20 of the fireplace, all of which represents conventional fireplace structure with the dimensional characteristics of the fireplace heater varying depending upon the dimensions of the fireplace in which the fireplace heater is installed.

The fireplace heater 10 includes a grate for receiving logs or other combustible fuel with the grate generally being designated by numeral 24 and including two sets of grate pipes including air inlet grate pipes 26 and air exhaust grate pipes 28 which are disposed in spaced parallel relation to each other and include a generally horizontally disposed lower portion, an upwardly curved rear portion and a forwardly and upwardly inclined upper portion as illustrated in FIG. 2. All of the grate pipes 26 and 28 are covered by a grate 30 as illustrated in FIG. 2 with the grate 30 setting on the grate pipes 26 and 28 and conforming to the shape and configuration of the forward and curved portion of the grate pipes. Interconnecting the forward end portion of the grate pipes 26 and 28 is a horizontally disposed lateral manifold 32 with the air inlet grate pipes 26 being communicated with the interior of the manifold 32 and the air exhaust grate pipes 28 extending through the manifold 32 and terminating in forwardly projecting ends 34 which also project through the air panel 18 so that the terminal forward ends of the projecting ends 34 of the air exhaust grate pipes 28 terminate substantially flush with the forward surface of the air panel 18 under the closure member 16 for discharge of heated air forwardly along the hearth or floor level. Air inlet is provided to one end of the manifold 32 by an air circulating fan 36 having a pipe or conduit 38 communicating with one end of the manifold 32. As illustrated, the air circulating fan 36 and the conduit 38 are disposed outwardly of the fireplace and may be oriented on the hearth 14 with the conduit 38 including appropriate elbows or other fittings so that it extends through an opening 40 in the air panel 18 and extends into and connects with an end cap 42 having a fitting 44 to which the conduit 38 is connected with the end cap 42 being releasably secured to the manifold 32 by screws or the like. The end cap 42 may be interchanged with a solid end cap 46 on the opposite end of the manifold 32 to enable the air circulating fan 36 and the conduit 38 to be optionally oriented to either the left or right side of the fireplace heater.

The upper ends of the grate pipes 26 and 28 are rigidly connected to and communicated with a horizontally disposed, transversely extending heat chamber 48 which has removable end caps 50 thereon corresponding to the end caps 46 or 42 so that conduits can be connected thereto, if desired, for discharge of heated air forwardly from the fireplace at any elevation desired or into duct works for conveying the heated air to any desired location. The heat chamber includes rigid nipples 52 along the bottom thereof which are rigidly affixed to the grate pipes 26 and 28 in any suitable manner such as by using set screws, or the like, which may also be used to connect manifold 32 to the pipes to enable disassembly and assembly of the components thereby enabling storage and shipment when in a compact knocked down condition. The heat chamber 48 communicates all of the grate pipes so that air entering the heat chamber from the air inlet grate pipes 26 will exit the heat chamber through the air exhaust grate pipes 28 for discharge of the heated air through the terminal projecting ends 34 at floor level. Any suitable number of grate pipes may be employed with alternate pipes being inlet and exhaust pipes or, if desired, a larger number of the exhaust pipes may be utilized to provide for expansion of the heated air during passage through the pipes and heating chamber. Depending upon the nature and size of the fire, heated air may be discharged into the room at floor level at approximately 500° F. For additional efficiency and heat, end tubes can be added to either end of the heat chamber 48 by utilizing an end cap 42 rather than an end cap 50 with such end tubes or conduits including elbows or any other fittings which can be swiveled in any direction for piping heated air into any desired area.

This unit is a stable unit and is supported from the hearth by the lower surface of the manifold 32 and downwardly projecting supporting legs 54 adjacent the juncture between the horizontal portion and the upwardly curved portion of the pipes. Thus, this unit can be installed in the fireplace and constitutes a stable, self-supported unit and may be used with the air panel 18 when a closure member 16 is employed. If a different type of closure member is employed for the fireplace opening, in some instances, the air panel 18 may not be used or may be modified. The air panel 18 is a rectangular, hollow filler member between the lower edge of the closure member 16 and the hearth 14 and may be secured to the lower end of the closure member 16 in any suitable manner with preformed openings formed therein or openings may be easily cut therein to receive the projecting ends 34 of the air exhaust grate pipes 28. The air circulating fan 36 may be of conventional construction or constructed in accordance with our copending application Ser. No. 955,171, filed Oct. 27, 1978, with the source of the air being the surrounding space or room or, if desired, air may be taken from the exterior of the house especially when a portion of this air will be used to support combustion through a forced draft assembly described hereinafter, thereby reducing heat loss up the chimney opening 22 due to the draft conditions induced within the interior of the house by the discharge of combustion products.

A reflector plate 56 extends transversely in front of the upper portions of the grate pipes 26 and 28 and the lower edge of the heat chamber with the upper edge of the reflector plate 56 being received behind a downwardly extending plate or flange 58 rigidly fixed to the front surface of the heat chamber 48 and extending downwardly therefrom in slightly spaced relation to the upper end portions of the grate pipes 26 and 28, so that the upper edge of the reflector plate 56 may be placed behind the plate 58 and moved upwardly so that rearwardly inclined tabs 60 formed in the lower edge of the plate 56 may pass over the top edge of the grate 30 and the reflector plate 56 then moved downwardly slightly so that the upper edge of the grate 30 is received between the tabs 60 and the bottom edge of the reflector plate 56 as illustrated in FIG. 2. The tabs 60 may be simply formed by lancing the lower edge of the reflector plate 56 and the tabs rearwardly deflected in a manner well-known in the art so that reflector plate 56 will be retained in position but can be easily assembled and disassembled when desired. The reflector plate will reflect heat forwardly from the fireplace heater so that radiated heat will be discharged into the room or space in which the fireplace heater is used.

A heat retaining plate 62 extends transversely of the fireplace heater substantially throughout the heat chamber 48 with the plate 62 extending normally forwardly and downwardly from the heat chamber 48 but the plate 62 is spaced vertically from the top surface of the heat chamber 48 so that combustion products may pass between the heat retaining plate 62 and the heat chamber 48. To provide for this spaced relationship, the rearward edge of the heat retaining plate 62 is pivotally attached to the top surface of the heat chamber 48 by hinge structures 64 which are in spaced relationship to each other and which space the heat retaining plates 62 from the heat chamber 48. The hinge structures 64 are located at the rear edge of the heat chamber 48 and the rear edge of the plate 62 and the forward edge of the heat chamber 48 is provided with a plurality of upwardly projecting stop pins 66 which engage the undersurface of the heat retaining plate 62 to maintain the heat retaining plate 62 in generally spaced parallel relation to the top surface of the heat chamber 48 as illustrated in FIG. 2 but with the forward edge of the heat retaining plate extending forwardly beyond the heat chamber 48 and terminating in a downwardly extending narrow flange 68 at its forward edge. This structure enables the heat retaining plate 62 to move from its normal operative position as illustrated in FIG. 2 to an elevated position illustrated in FIG. 4 to enable placement of relatively large logs into the fireplace heater. In order to temporarily retain the heat retaining plate 62 in its open or elevated position as illustrated in FIG. 4, a pivotal prop 70 is attached to the undersurface of the plate 62 in a manner such that it will fall due to gravity into an inclined position with the lower end setting on heating chamber 48 to prop the heat retaining plate 62 in its open or elevated position when it is elevated to a position such that the prop 70 will assume a vertical position so that subsequent release of the plate 62 will cause the prop 70 to slide down and forwardly along the top surface of the heat chamber 48 and rest thereon. When it is desired to lower the plate 62 to its operative position, a conventional poker may elevate the plate and be engaged with the prop 70 adjacent its lower end and the lower end of the prop 70 may then be moved to its folded or collapsed position with the heat retaining plate 62 then being lowered to its operative position.

The forward portion of the grate 30 is upwardly inclined as at 72 so that it passes above the manifold 32 with the upwardly inclined portion 72 terminating in a downturned flange 73 and a pair of upstanding brackets 74 are rigidly secured thereto with the lower ends of the brackets 74 being inclined as at 76 and attached in any suitable manner to the inner surface of the upwardly inclined portion 72 of the grate 30. Attached to the brackets 74 is a log retaining plate 78 secured to the outer surface of the brackets 74 by fasteners 80 or the like which serves to retain logs, sparks and coals on the grate 30. As illustrated in FIG. 2, the space between the top edge of the log retaining plate 78 and the forward edge of the heat retaining plate 62 provides access to the interior of the fireplace heater and this space is closed by a cover plate 82 which has spaced tabs 84 formed in the lower edge thereof by lancing the lower edge of the cover plate 82 and deflecting the tabs 84 so that the downwardly opening notches formed thereby will be engaged over the top edge of the log retaining plate 78. The top edge of the cover plate 82 rests against the downwardly inclined flange 68 of the heat retaining plate 62 which is inwardly of the top edge of the log retaining plate 78 so that gravity will retain the cover plate in position. The cover plate is provided with a loop 86 on its outer surface adjacent the center upper edge thereof which facilitates the insertion of the poker hook, or the like, therein to lift the cover plate upwardly away from the heat retaining plate 62 and the log retaining plate 78 so that it can be set aside when logs or other combustible fuel is being added to the fireplace heater. Thus, with the heat retaining plate 62 in its operative position and the cover plate 82 in position, the logs or other combustible fuel supported on the grate 30 will effectively heat all the components and the combustion products will pass between the heat chamber 48 and the heat retaining plate 62 with the space for such passage being designated by reference numeral 88 which assures efficient heat transfer between the adjacent surface areas of the furnace heater and the air passing through the heat chamber 48. The structural components may be constructed of any suitable material having requisite strength characteristics and requisite characteristics to resist deterioration from high temperatures.

The end of the fireplace heater may be partially closed with an end plate or end plates 90 which conform with the inner surfaces of the grate 30 and log retaining plate 78. The end plate 90 is retained in position on the grate by two or more projecting tongues along the edges thereof which are received in slot-like openings 92 formed in the side edge portions of the grate 30 with the two tongues and slots being spaced longitudinally and generally in surfaces at the rearward curved portion of the grate and either in the horizontal portion adjacent the forward edge thereof or in the inclined portion 72 of the grate 30.

A forced draft assembly 94 is disposed alongside of the end of the fireplace heater adjacent the end edge of the grate 30 in generally parallel relation thereto and is in the form of a pipe 96 connected to the conduit 38 extending from the air circulating fan 36 into the manifold 32. The pipe 96 is connected to the conduit 38 adjacent its point of connection with the manifold 32 and is connected thereto in any suitable manner with the opposite end of the pipe 96 being plugged or closed so that the interior of the pipe is provided with air under pressure from the circulating fan 36. The pipe or tube 96 is provided with a plurality of longitudinally spaced holes 98 therein which are selectively opened and closed by a sliding sleeve 100 having corresponding holes 102 for selective registry with the holes 98. Any suitable means such as a pin and slot arrangement 104 interconnects the pipe 96 and the sleeve 100 to limit the longitudinal movement of the sleeve and to retain the sleeve 100 from becoming angularly displaced. An elongated operating rod 106 is connected to the sleeve 100 and extends outwardly generally in a parallel relation to the pipe 96 and terminates in an operating knob 108 outwardly of the manifold 32 and outwardly of the air panel 18 if the air panel is being used. A supporting prop 110 is attached to the inner end of the pipe 96 for support of the same from the hearth with the support leg or prop 110 being reversible so that the forced air draft assembly 94 may be used either to the left or to the right of the fireplace heater. Also, the connection between the operating rod 106 and the sleeve 100 is reversible in a similar manner so that the operating rod 106 will be disposed at the bottom inner portion of the air draft pipe 96 when it is placed at the opposite side of the fireplace heater. Our prior U.S. Pat. No. 3,930,490 also discloses a forced draft similar in function to draft assembly 94.

It is pointed out that the fireplace heater as disclosed fully contains the fire thus providing for a longer burning, low flame fire with heat being prevented from flowing directly up and out the chimney. Rather, heat must flow under the heat retaining plate and over and around the top heating chamber thus effectively extracting heat from the combustion products before these gases exit through the space provided between the top heating chamber and the heat retaining plate. Thus, high efficiency and intense heat is obtained since the cold air flows in and upwardly into the heating chamber and then downward for discharge into the room with the circulating air extracting heat from the combustion products throughout its passage through the fireplace heater. The removable cover plate 82 and the hinged heat retaining plate 62 enables large logs to be effectively loaded into the fireplace heater. The cover plate 82 may be lifted and easily handled, even when hot, with a conventional poker and the same poker may be used for lifting the front edge of the heat retaining plate 62 to move it to its elevated position and also used to move the prop to collapsed position to lower the heat retaining plate 62 after logs have been placed into the fireplace heater. The interchangeable end caps on the manifold and heat chamber enable the forced air circulating fan and forced draft assembly to be installed at either side of the fireplace heater. Also, end caps with nipples may be provided at either or both ends of the heat chamber to which conduits are connected for conveying heated air into any desired area. The optional end plates and optional forced draft assembly enables not only retention of the heat and fire but also adequate supply of combustion supporting air. If a forced draft is not desired or necessary, the usual draft at the lower end of the closure member may be employed for supplying combustion supporting air and the forward portion of the grate may be provided with a conventional slide draft to enable inflow of combustion supporting air into the area containing the logs or other combustible fuel. The heat reflector plate 56 prevents heat from being absorbed by the back wall of the fireplace and reflects radiant heat towards the front of the fireplace. Also, the construction of the various components enable assembly and disassembly thereof so that the components can be stored and shipped in a knocked down condition and then easily set up at the site of installation. For example, the pipes 26 and 28 may be connected to the manifold and chambers by a telescopic arrangement between short nipples and the ends of the pipes and a single screw extending through the nipples into engagement with the pipes, so that the plates are detachable from the tubes and detachable from each other.

The structure of the grate, forced draft and heat retainer is of one standard depth and is placed to the very back of the fireplace and is so designed that the back curvature of the heater allows for conventional construction of the fireplace having back wall tapering inwardly to the fireplace throat. Varying depths of fireplaces are provided for by simply varying the length of air tubes which are furnished to allow for the greatest depth fireplaces and which can easily be cut to desired length in the field. The grate simply sets on and over all the heater tubes, the grate being formed of one standard shape.

The grate is a very important and integral functioning part of the fireplace heater by providing a firebox that extracts the energy and heat to the highest degree of efficiency, adding a great measure of safety by providing a low, hot burning fire, prevents danger of sparks or logs rolling out or into glass doors, allows large logs to be used for continuous burning, allows for efficiently burning newspapers. The grate will outlast cast iron grates and can easily be repaired when burn through does occur.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fireplace heater comprising a plurality of generally parallel tubular members interconnected to support a log or other fuel within a fireplace, each tubular member including a generally horizontal front portion and an upwardly extending rear portion adjacent the rear wall of the fireplace, a hollow heat chamber interconnecting and intercommunicating the upper ends of the rear portions of all of the tubular members, a hollow manifold interconnecting the front ends of the tubular members adjacent the front lower portion of the fireplace and communicating only with certain of the tubular members, the other tubular members including forward end portions projecting through the manifold, an air circulation means connected with and communicated with the manifold for forcing air into the manifold, through the tubular members communicated therewith into the heat chamber and then out through the tubular members extending through the manifold for discharge of heated air at the forward lower end of the fireplace heater adjacent floor level, each tubular member being in the form of a pipe with the front portion and rear portion being interconnected by a curved portion with the rear portions extending upwardly and the heat chamber disposed adjacent a flue passageway of a chimney, and a grate setting on said pipes to provide a log support, said grate extending substantially completely over the front portions of the pipes, and a reflector plate extending between the rear edge of the grate and the heat chamber for reflecting radiant heat outwardly of the fireplace and reducing passage of heat into the rear wall of the fireplace.

2. A fireplace heater comprising a plurality of generally parallel tubular members interconnected to support a log or other fuel, each tubular member including a generally horizontal front portion and an upwardly extending rear portion, a hollow heat chamber interconnecting and intercommunicating the upper ends of the rear portions of the tubular members, a hollow manifold interconnecting the front ends of the tubular members and communicating only with certain of the tubular members, the other tubular members including forward end portions projecting through the manifold, an air circulation means connected with and communicated with the manifold for forcing air through the manifold, through the tubular members communicated therewith into the heat chamber and then out through the tubular members extending through the manifold for discharge of heated air at the forward lower end of the fireplace heater adjacent floor level, each tubular member being in the form of a pipe with the front portion and rear portion being interconnected by a curved portion with the rear portions extending upwardly and the heat chamber disposed adjacent a flue passageway of a chimney, and a grate setting on said pipes to provide a log support, said grate extending completely over the front portions of the pipes, a reflector plate extending between the rear edge of the grate and the heat chamber for reflecting radiant heat outwardly of the fireplace and reducing passage of heat into the rear wall of the fireplace, a heat retaining plate disposed above and projecting forwardly from the heat chamber, means mounting the heat retaining plate in generally parallel and vertically spaced relation to the heat chamber to provide a passageway for hot combustion products thereby assuring passage of the hot combustion products over and around the heat chamber for more efficient extraction of heat from the combustion products.

3. The structure as defined in claim 2 wherein said means mounting the heat retaining plate includes a pair of spaced hinges interconnecting the rearward edge of the heat retaining plate with the heat chamber in vertically spaced relation thereto, and projecting stop members on the heat chamber to limit the downward pivotal movement of the forward edge portion of the heat retaining plate to maintain the spaced relation between the heat retaining plate and heat chamber.

4. The structure as defined in claim 3 together with a generally vertical log retaining plate extending upwardly from the forward edge of the grate, and a cover plate extending between the top edge of the log retaining plate and the heat retaining plate with the forward edge of the heat retaining plate being rearwardly of the upper edge of the log retaining plate, whereby the cover plate will be inclined upwardly and rearwardly and retained in position by gravity.

5. The structure as defined in claim 4 wherein said cover plate includes means on the exterior thereof for engagement by a poker for removal and replacement of the cover plate even when hot to enable additional logs to be placed in the fireplace heater.

6. The structure as defined in claim 5 wherein said heat retaining plate includes a pivotal prop on the undersurface thereof in spaced relation to the pivotal connection between the heat retaining plate and heat chamber, said prop including a lower end engageable with the heat chamber when the heat retaining plate is elevated to retain the heat retaining plate in elevated position to facilitate loading of logs into the fireplace heater, said prop being rendered inoperative by a poker to lower the heat retaining plate to operative position.

7. The structure as defined in claim 6 together with an end plate forming a partial closure for the fireplace heater with the end plate including spaced projecting tongues on the lower peripheral edge thereof for reception in slots in the grate to enable installation of and removal of the end plate.

8. The structure as defined in claim 7 together with a forced draft assembly alongside of the fireplace heater in communication with the air circulating means and including controlled air discharge apertures facing the edge of the grate for discharge of combustion supporting air toward the logs or other combustible fuel on the grate.

9. The structure as defined in claim 8 together with a closure member for a fireplace opening in which the fireplace heater is installed, an air panel disposed below the closure member forwardly of the manifold with the forward ends of the pipes which extend through the manifold also extending through the air panel to provide for discharge of heated air into a room adjacent floor level.

10. The structure as defined in claim 9 wherein said fireplace heater is of compact construction so that it will fit under a conventional fireplace damper arm, said heat reflector plate providing efficient use of heat, said forced draft assembly providing easy fire starting and fast heat production, said grate saving fuel, and said fireplace heater providing safety against fires and continuous burning of fire therein.

* * * * *